US006666112B2

(12) United States Patent
Hu

(10) Patent No.: US 6,666,112 B2
(45) Date of Patent: Dec. 23, 2003

(54) SWITCHING ARRANGEMENT FOR A REVERSIBLE RATCHET TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/900,997

(22) Filed: Jul. 9, 2001

(65) Prior Publication Data

US 2002/0026858 A1 Mar. 7, 2002

(30) Foreign Application Priority Data

Sep. 1, 2000 (TW) ..... 89215264 U

(51) Int. Cl.[7] ..... B25B 13/46
(52) U.S. Cl. ..... 81/63.1; 192/43.2
(58) Field of Search ..... 81/60–63.2; 192/43.1, 192/43.2

(56) References Cited

U.S. PATENT DOCUMENTS

| | | | | |
|---|---|---|---|---|
| 15,482 A | | 8/1856 | Gilman | |
| 810,599 A | | 1/1906 | Ansorge | |
| 841,686 A | | 1/1907 | Hatfield | |
| 893,097 A | | 7/1908 | Reams | |
| 915,446 A | | 3/1909 | Kearnes | |
| 1,033,358 A | | 7/1912 | Turner | |
| 1,194,471 A | | 8/1916 | Boosinger | |
| 1,261,092 A | | 4/1918 | Allen | |
| 1,382,492 A | | 6/1921 | Evans | |
| 1,426,127 A | | 8/1922 | Tuttle | |
| 1,614,039 A | | 1/1927 | Mandl | |
| 1,957,462 A | | 5/1934 | Kress | |
| 2,193,984 A | * | 3/1940 | Rhinevault | 81/63.1 |
| 2,201,705 A | * | 5/1940 | Stone | 81/63.1 |
| 2,201,827 A | * | 5/1940 | Foreschl et al. | 81/63.1 |
| 2,317,461 A | | 4/1943 | Jackson | |
| 2,542,241 A | | 2/1951 | Fors | |
| 2,657,604 A | | 11/1953 | Rueb | |
| 2,701,977 A | | 2/1955 | Stone | |
| 2,764,048 A | | 9/1956 | Thompson | |
| 2,769,360 A | | 11/1956 | Cottrell et al. | |
| 2,800,821 A | | 7/1957 | Fruscella | |
| 2,891,434 A | | 6/1959 | Lozensky | |
| 2,957,377 A | | 10/1960 | Hare | |
| 2,978,081 A | * | 4/1961 | Lundin | 192/43.1 |
| 3,019,682 A | | 2/1962 | Hare | |
| 3,250,157 A | | 5/1966 | Badger | |
| 3,265,171 A | | 8/1966 | Kilness | |
| 3,337,014 A | | 8/1967 | Sandrick | |
| 3,393,587 A | | 7/1968 | Jolliff et al. | |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—James G. Smith
(74) *Attorney, Agent, or Firm*—Alan D. Kamrath; Rider Bennett, LLP.

(57) ABSTRACT

A wrench includes a handle and a head extended from the handle. The handle includes a transverse receptacle communicated with a hole in the head and a cavity that communicates with the transverse receptacle. Two pawls are mounted in the transverse receptacle and each include a first side for releasably engaging with a drive member in the hole of the head and a second side abutting against an inner longitudinal wall of the transverse receptacle. A switch member is rotatably mounted in the cavity of the handle and includes an actuating portion for selectively moving one of the pawls to a position not engaging with the drive member. The switch member further includes two support portions for selectively supporting a portion of the other pawl that disengages from the inner longitudinal wall of the transverse receptacle, thereby supporting the other pawl that engages with the drive member.

20 Claims, 21 Drawing Sheets

U.S. PATENT DOCUMENTS 3,393,780 A 7/1968 Kilness
3,436,992 A 4/1969 Over et al.
3,577,816 A 5/1971 Alexander et al.
3,713,356 A 1/1973 Knudsen
3,742,788 A 7/1973 Priest
3,838,614 A 10/1974 O'Donnell
3,908,487 A 9/1975 Plaw
4,070,932 A 1/1978 Jeannotte
4,111,077 A 9/1978 Cummings et al.
4,128,025 A 12/1978 Main et al.
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Deibert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,807,500 A 2/1989 Main
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,495,783 A 3/1996 Slusar et al.
5,499,560 A 3/1996 Aeschliman
5,501,124 A 3/1996 Ashby
5,509,333 A 4/1996 Rion
5,533,427 A 7/1996 Chow
5,557,994 A 9/1996 Nakayama
5,582,081 A * 12/1996 Lin ..... 81/63.1
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen
6,205,889 B1 3/2001 Hsieh
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,282,993 B1 9/2001 Forman et al.
6,301,998 B1 10/2001 Hu
2001/0035074 A1 11/2001 Hu
2002/0017169 A1 2/2002 Hu
2002/0023519 A1 2/2002 Hu
2002/0023520 A1 2/2002 Hu

* cited by examiner

SWITCHING ARRANGEMENT FOR A REVERSIBLE RATCHET TYPE WRENCH

BACKGROUND OF THE INVENTION

1. Field of the Invention

The present invention relates to a switching arrangement for a reversible ratchet-type wrench to provide reliable ratcheting and to allow easy assembly and manufacture.

2. Description of the Related Art

Several factors are considered in designing wrenches and spanners, including improving the torque-bearing capacity, providing as many teeth as possible for the drive member, and providing an easy-to-manufacture structure. U.S. Pat. No. 2,957,377 issued to Hare on Oct. 25, 1960 discloses a reversible ratchet type wrench comprising a body 10 having a handle 11 and a head 12. A cap 39 and an annular wall 44 are provided to upper side and lower side of the head 12, respectively. Yet, this increases the assembly time and the manufacture cost and adversely affects the appearance. A shifting lever 35 is retained in place by a spring 33 that is located in a cylindrical opening 34. Nevertheless, formation of the cylindrical opening 34 that extends upward at an incline is relatively difficult. In addition, formation of the cavity 16 having converging straight sides 17, 18 which diverge in the direction of the periphery of rotatable member 14 requires expensive and accurate computer-numeric-control (CNC), which further results in an increase in the cost together with a low production rate. This is why such a reversible ratchet type wrench is hardly seen in the market.

FIGS. 13 and 14 illustrate another conventional ratchet type wrench comprising a handle 12' and a head 11'. The head 11' is machined to form four consecutive compartments for receiving the drive member 20', the pawl 30' and the shifting lever 40', wherein three of the compartments can be formed by cutting, yet the remaining one must be machined by CNC. Further, the resultant head structure is relatively weak and thus has a poor torque-bearing capacity. In addition, the movement of the pawl 30' for changing ratcheting direction is found unreliable, as it is achieved via transmission of the hook end 442' of a spring 44' attached to the shifting lever 40'.

FIG. 15 of the drawings illustrates a conventional wrench of the type having a handle B' and a head in which a drive member A' is rotatably received. A pawl D' is slidably received in a transverse through-hole C' in a web between the handle B' and the head. However, an end of the pawl D' extends beyond the transverse through-hole C' and thus adversely affects operation of the wrench when used in a limited space. A two-pawl type wrench was proposed to solve this problem. As illustrated in FIGS. 16 through 18, the two-pawl type wrench includes a handle 1' and a head 11' extended from the handle 1'. A drive member 2' is rotatably received in the head 11', a receptacle 121' is defined in a web 12' between the handle 1' and the head 11', and a spring-biased switch member 4' is mounted in a cavity 13' in the web 12'. Two spaced pawls 3' are received in the receptacle 121' and are biased by two springs 6', respectively. A threaded end cap 5' is engaged with a threaded outer end of the receptacle 121' to enclose the pawls 3' and springs 6'. As illustrated in FIGS. 17 and 18, the switch member 4' is turned to bias one of the pawls 3' to engage its teeth 31' with the drive member 2' to thereby change the ratcheting direction of the wrench. However, it was found that the switch member 4' cannot be reliably retained in place and thus tends to disengage from the cavity 13'. In addition, the pawl 3' engaged with the drive member 2' is not engaged with an inner longitudinal wall that defines the transverse through-hole and that faces the drive member 2'. As a result, the torque-bearing capacity of the wrench is poor. Furthermore, the outer pawl 3' (FIGS. 17 and 18) tends to be stuck when the threaded end cap 5' is mounted too close to the switch member 4'. To the contrary, if the threaded end cap 5' is too far away from the switch member 4', the pawl 3' cannot be firmly engaged with the drive member 2'. Further, the threaded end cap 5' tends to be disengaged from the drive member 2', as the former is in threading engagement with the threaded outer end of the receptacle 121'.

FIGS. 19 through 21 illustrate another conventional wrench having a substantially V-shape transverse through-hole 25' in a web between a handle 20' and a head 21' thereof. The head 21' includes a compartment in which a drive member 22' is rotatably received. A spring-biased pawl 23' is received in each limb of the V-shape transverse through-hole 25'. A switch member 30' includes a stem 35' pivotally received in a cavity 24' in the web and a thumb-piece 32' extending from the stem 35' for manual operation, thereby switching the switch member 30' between two positions corresponding to two opposite ratcheting direction of the wrench. The thumb piece 32' of the switch member 30' includes a downwardly facing receptacle 36' (FIG. 21) for receiving a spring 37' and a ball 38' that is biased by the spring 37' to be positioned in one of two positioning recesses 281' (FIG. 20) in a sector-like recessed area 28' (FIG. 19) of the web. The switch member 30' may be retained in place reliably. However, a C-clip 33' is required for mounting the switch member 30' in place, which adversely affects the aesthetically pleasing effect. In addition, processing of the sector-like recessed area 28' in the web and the V-shape transverse through-hole 25' is difficult. Mounting of the switch member 30' as well as the pawl 23' and associated springs 26' and threaded end caps 27' are troublesome and time-consuming. The sector-like recessed area 28' in the web results in an increase in the overall thickness of the wrench, which limits application of the wrench in limited spaces. The torque-bearing capacity was found poor, as only a portion of the pawl 23' meshed with the drive member 22' was supported by the inner wall of the V-shape transverse through-hole 25', as shown in FIG. 20.

SUMMARY OF THE INVENTION

In accordance with the present invention, a reversible ratchet type wrench comprises:

a handle;

a head extended from the handle and including a hole, the handle comprising a transverse receptacle communicated with the hole, the transverse receptacle comprising an inner longitudinal wall that faces the hole of the head, the handle further comprising a cavity that communicates with the transverse receptacle;

a drive member rotatably mounted in the hole of the head, the drive member including a plurality of teeth formed on an outer periphery thereof;

two pawls mounted in the transverse receptacle in a spaced manner and each including a first side with a plurality of teeth for releasably engaging with the teeth of the drive member and a second side abutting against the inner longitudinal wall of the transverse receptacle;

a switch member including a turn-piece for manual operation, the switch member being rotatably mounted in the cavity of the handle and comprising an actuating portion for selectively moving one of the pawls to a position not engaging with the teeth of the drive member, the switch member further comprising two support portions for selectively supporting a portion of the other pawl that disengages from the inner longitudinal wall of the transverse receptacle, thereby supporting the other pawl that engages with the teeth of the drive member; and means for biasing the teeth of the pawls to engage with the teeth of the drive member, respectively.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
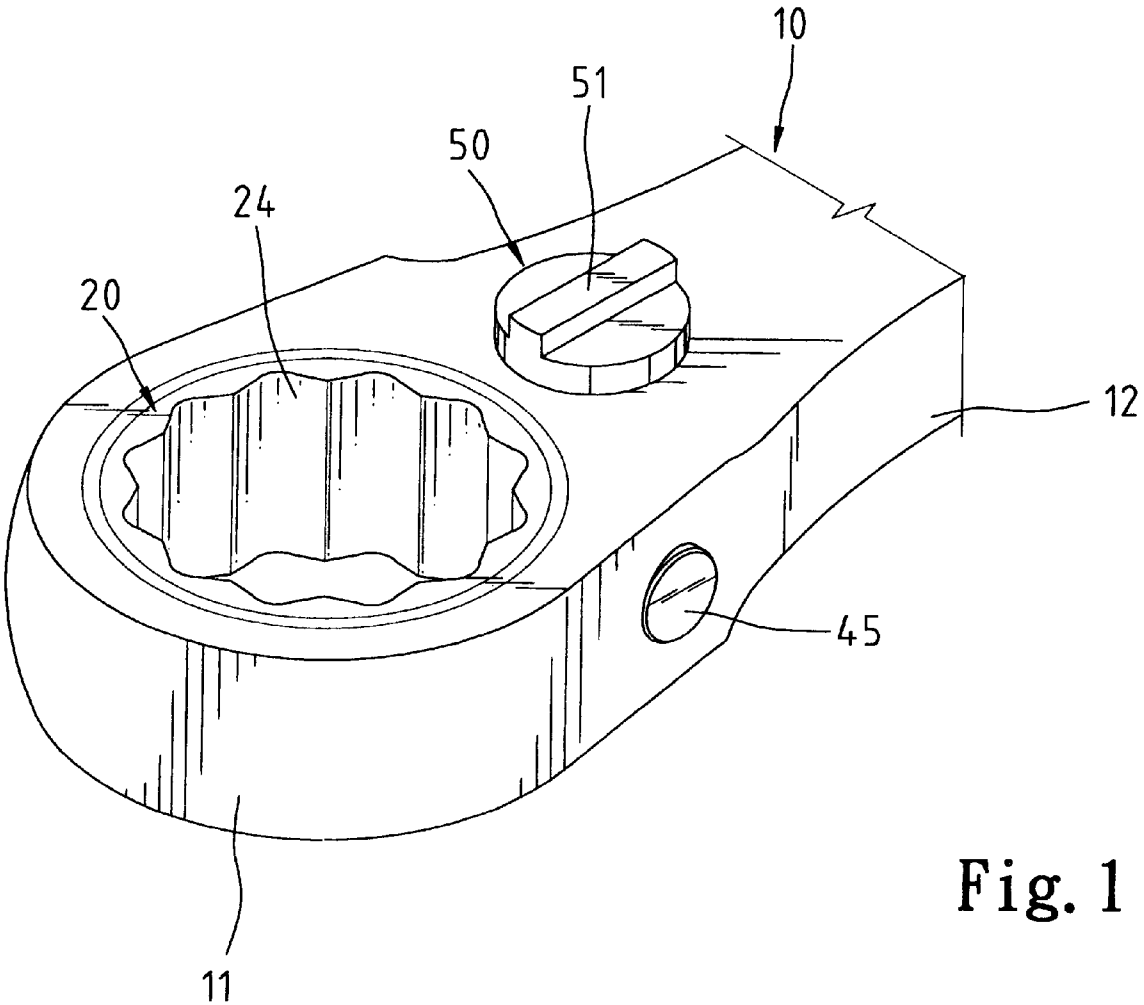
FIG. 1 is a perspective view of an end portion of a first embodiment of a wrench in accordance with the present invention.

Referring to FIGS. 1 through 12 and initially to FIGS. 1 through 4, a ratchet type wrench 10 in accordance with the present invention generally includes a handle 12 and a head 11 having a hole 13. An inner periphery defining the hole 13 of the head 11 includes an annular groove 132 in an upper portion thereof and an annular ledge 131 on a lower portion thereof. A transverse receptacle 14 extending transversely to the inner periphery of the hole 13 (FIG. 4) is defined in the handle 12 and includes an intermediate portion communicated with the hole 13. The transverse receptacle 14 extends from one lateral side 19*b* of the handle 12 toward the other lateral side 19*a* of the handle 12 but spaced from the other lateral side 19*a*, thereby defining an opening 141 in the lateral side 19*b*. The transverse receptacle 14 includes an inner wall 142 (FIG. 4) that extends longitudinally of the transverse receptacle 14 and that faces the hole 13, which will be described later. A cavity 15 is defined in the handle 12 and communicated with the transverse receptacle 14. The cavity 15 communicated with the transverse receptacle 14 has a first end communicated with outside and a second end located in the handle 12, thereby leaving a bridge 16 on the handle 12 for connecting with the head 11. Namely, the cavity 15 extends from an upper side of the handle 12 toward a bottom side of the handle 12 but spaced from the bottom side of the handle 12, best shown in FIG. 3. The cavity 15 is preferably cylindrical. The bridge 16 increases the strength of the head 11 and the handle 12, thereby providing a higher torque-bearing capacity.

Figure 3:
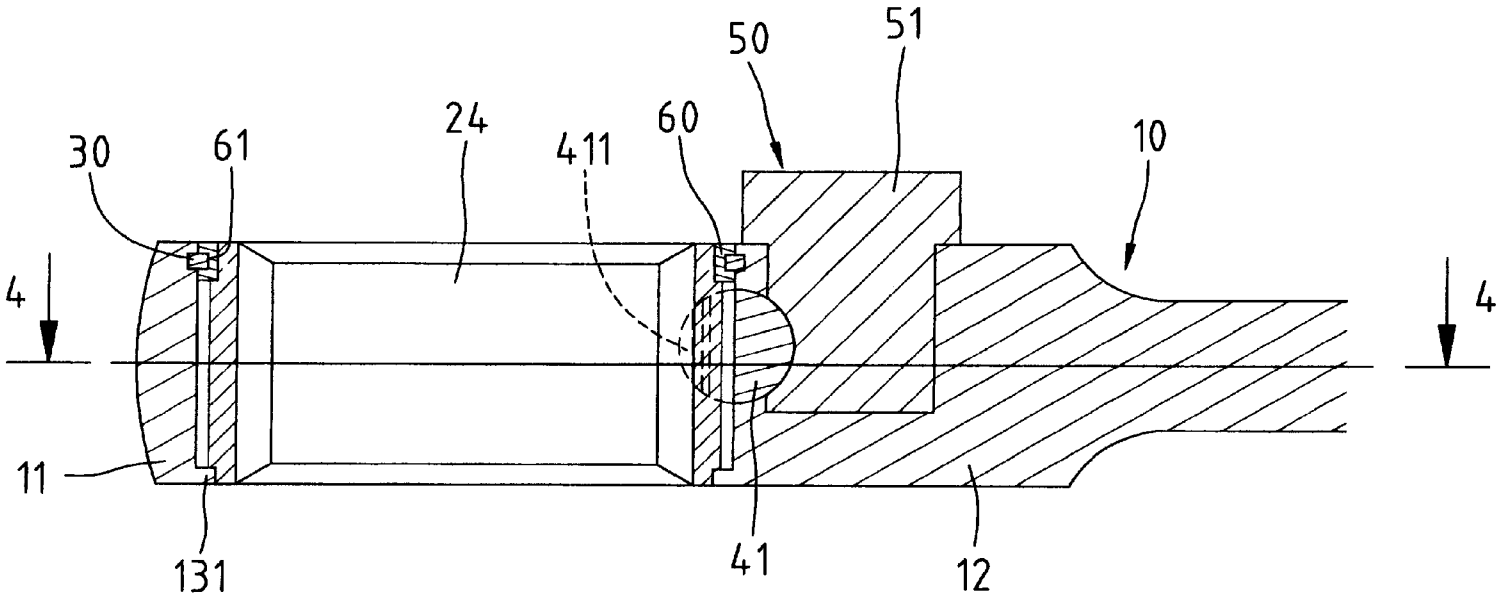
FIG. 3 is a sectional view of the wrench in FIG. 1.

A drive member (in the form of a gear wheel 20 in this embodiment) is mounted in the head 11 and includes an inner periphery 24 for driving a fastener (not shown) and an outer periphery 25. The outer periphery 25 includes a recessed upper end portion 22, a recessed lower end portion 23, and a middle portion with a plurality of recessed teeth 21. A retainer 60, preferably a ring, is mounted around the recessed upper end portion 22 and includes an annular groove 61. A C-clip 30 is engaged in the annular groove 61 of the retainer 60 and in the annular groove 132 of the hole 13, thereby rotatably retaining the gear wheel 20 in the head 11 of the wrench 10, best shown in FIG. 3. As illustrated in FIG. 3, the recessed lower end portion 23 abuts against and is thus supported by the annular ledge 131 of the head 11.

Two pawls 41 and 42 are mounted in the transverse receptacle 14 in a spaced manner and each include ratchet teeth 411, 421 on a side thereof for engaging with teeth 21 of the gear wheel 20. The ratchet teeth 411, 421 are preferably arranged along a concave face so as to be in intimate contact with the teeth 21 of the gear wheel 20. The other side 412, 422 of each pawl 41, 42 presses against the inner longitudinal wall 142, best shown in FIG. 4. The inner pawl 41 further includes an end 413 to which an end of an elastic element (e.g., a spring 43) is attached, the other end of the spring 43 being attached to an end wall defining the transverse receptacle 14. The outer pawl 42 includes an outer end 423 to which an elastic element (e.g., a spring 44) is attached. An end cap 45 is securely mounted in the opening 141 of the transverse receptacle 14, and the other end of the spring 44 is attached to an inner side of the end cap 45 such as being received in bore 451 formed in end cap 45. Thus, the respective pawl 41, 42 is biased by the respective spring 43, 44 toward the gear wheel 20.

Figure 2:
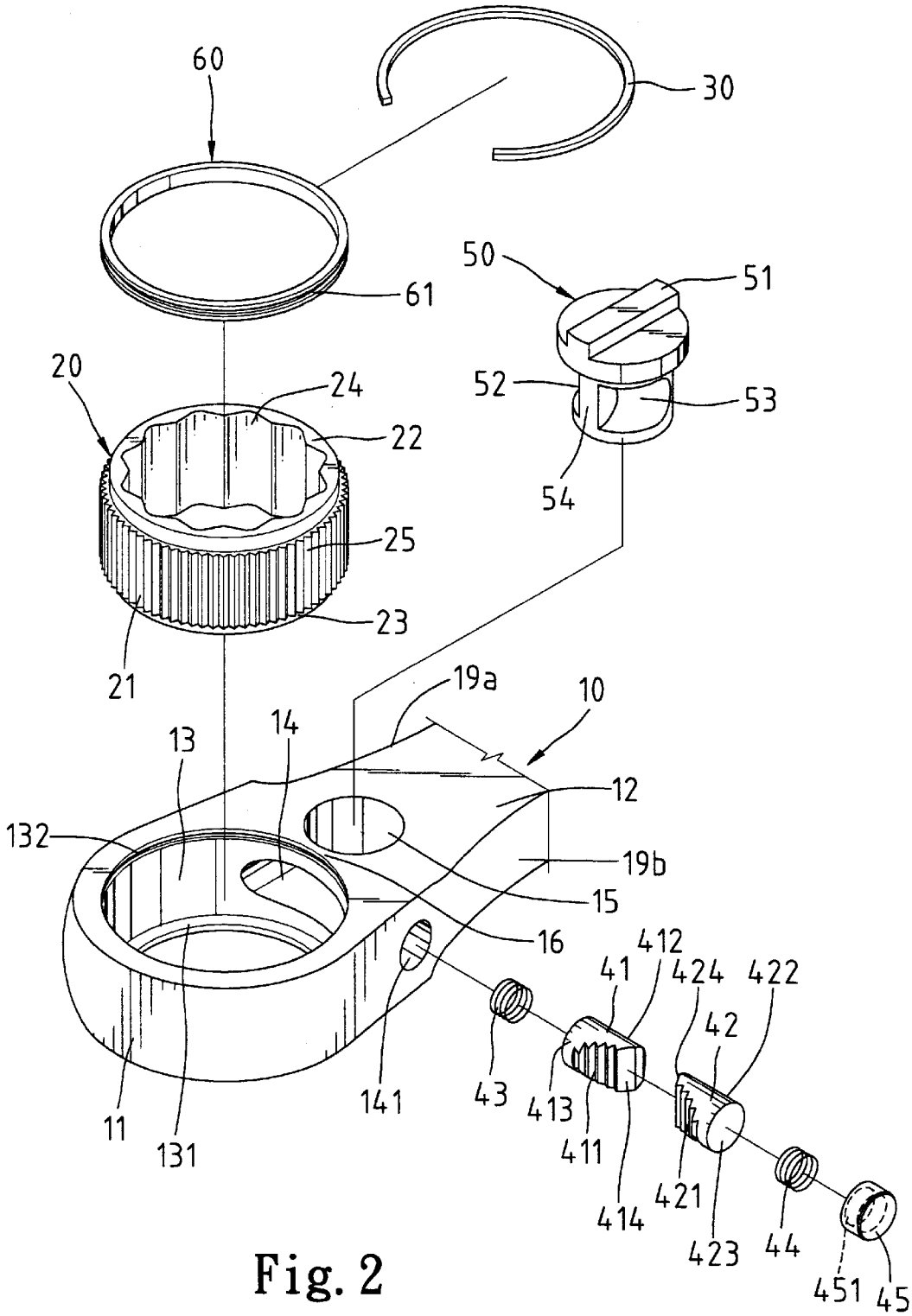
FIG. 2 is an exploded perspective view of the wrench in FIG. 1.

Still referring to FIGS. 1 through 3, a switch member 50 is rotatably mounted in the cavity 15. In this embodiment, the switch member 50 includes a turn-piece 51 on a top thereof, the turn-piece 51 being preferably located outside the cavity 15 for manual operation. The switch member 50 comprises an actuating portion 54 for selective engagement with an end 414, 424 of the respective pawl 41, 42. The switch member 50 further comprises two support portions 52 and 53 each for supporting a portion of the second side 412, 422 of the respective pawl 41, 42, best shown in FIG. 4. It is noted that the switch member 50 includes a bottom 56 that is located below the pawls 41 and 42 after assembly, thereby preventing disengagement of the switch member 50.

Figure 4:
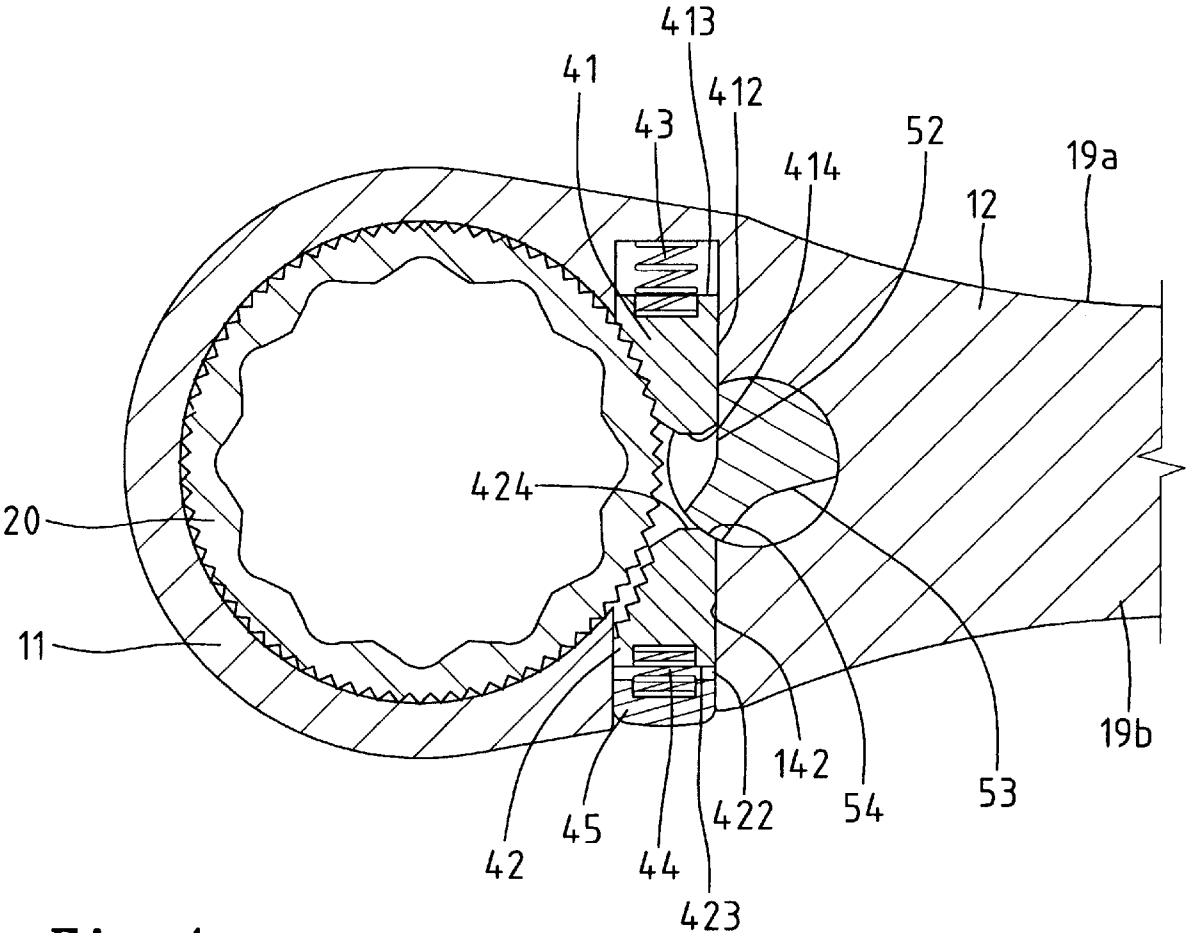
FIG. 4 is a sectional view taken along line 4—4 in FIG. 3, wherein the wrench is in a status allowing clockwise ratcheting.

The ratchet type wrench in FIG. 4 is in a status allowing clockwise ratcheting (free rotation in counterclockwise direction), in which the actuating portion 54 of the switch member 50 presses against the end 424 of the pawl 42, thereby disengaging the pawl 42 from the gear wheel 20. The other pawl 41 is biased by the spring 43 toward the gear wheel 20. The teeth 411 of the pawl 41 are in intimate contact with the gear wheel 20 and the leading portion (not labeled) of the second side 412 of the pawl 41 that leaves the inner longitudinal wall 142 of the transverse receptacle 14 is supported by the support portion 52 of the switch member 50. A higher torque is provided, as the drive member 20 is firmly engaged with and in intimate contact with the teeth 411 of the pawl 41. In addition, the force transmitted to the pawl 41 from the drive member 20 is distributed to the inner longitudinal wall 142 of the transverse receptacle 14 having a relatively large area. As a result, the wrench in accordance with the present invention may bear higher torque.

Figure 5:
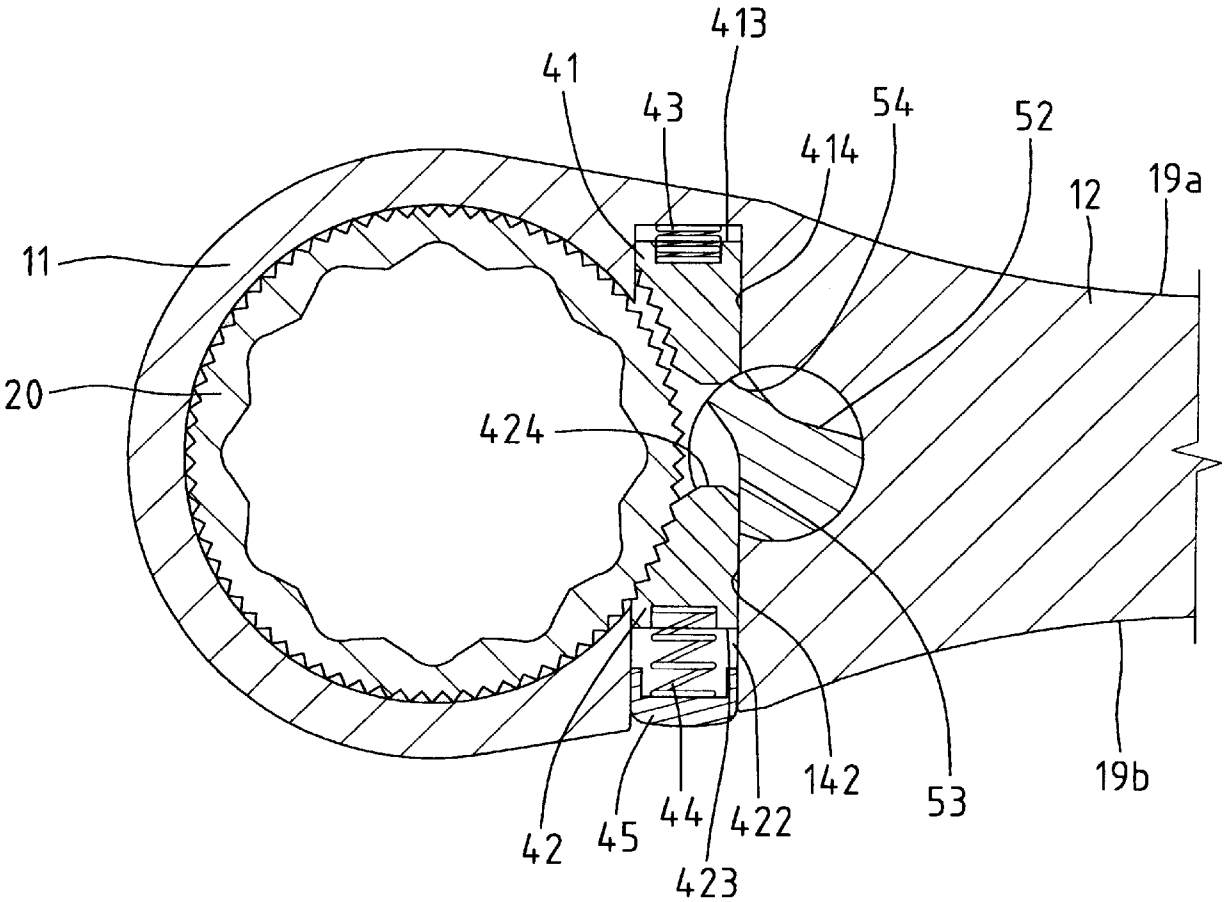
FIG. 5 is a view similar to FIG. 4, wherein the wrench is in a status allowing counterclockwise ratcheting.

When a change in the ratcheting direction is required, the user may switch the turn-piece 51 and thus move the actuating portion 54 of the switch member 50 to press against the pawl 41. Thus, the ratchet-type wrench is in a status allowing counterclockwise ratcheting and free rotation in the clockwise direction. As illustrated in FIG. 5, the actuating portion 54 of the switch member 50 presses against the end 414 of the pawl 41, thereby disengaging the pawl 41 from the gear wheel 20. The pawl 42 is biased by the spring 44 toward the gear wheel 20. The teeth 421 of the pawl 42 are in intimate contact with the gear wheel 20 and the leading portion (not labeled) of the second side 422 of the pawl 42 that leaves the inner longitudinal wall 142 of the transverse receptacle 14 is supported by the support portion 53 of the switch member 50. A higher torque is provided, as the drive member 20 is firmly engaged with and in intimate contact with the teeth 421 of the pawl 42. In addition, the force transmitted to the pawl 42 from the drive member 20 is distributed to the inner longitudinal wall 142 of the transverse receptacle 14 having a relatively large area. As a result, the wrench in accordance with the present invention may bear higher torque.

Figure 6:
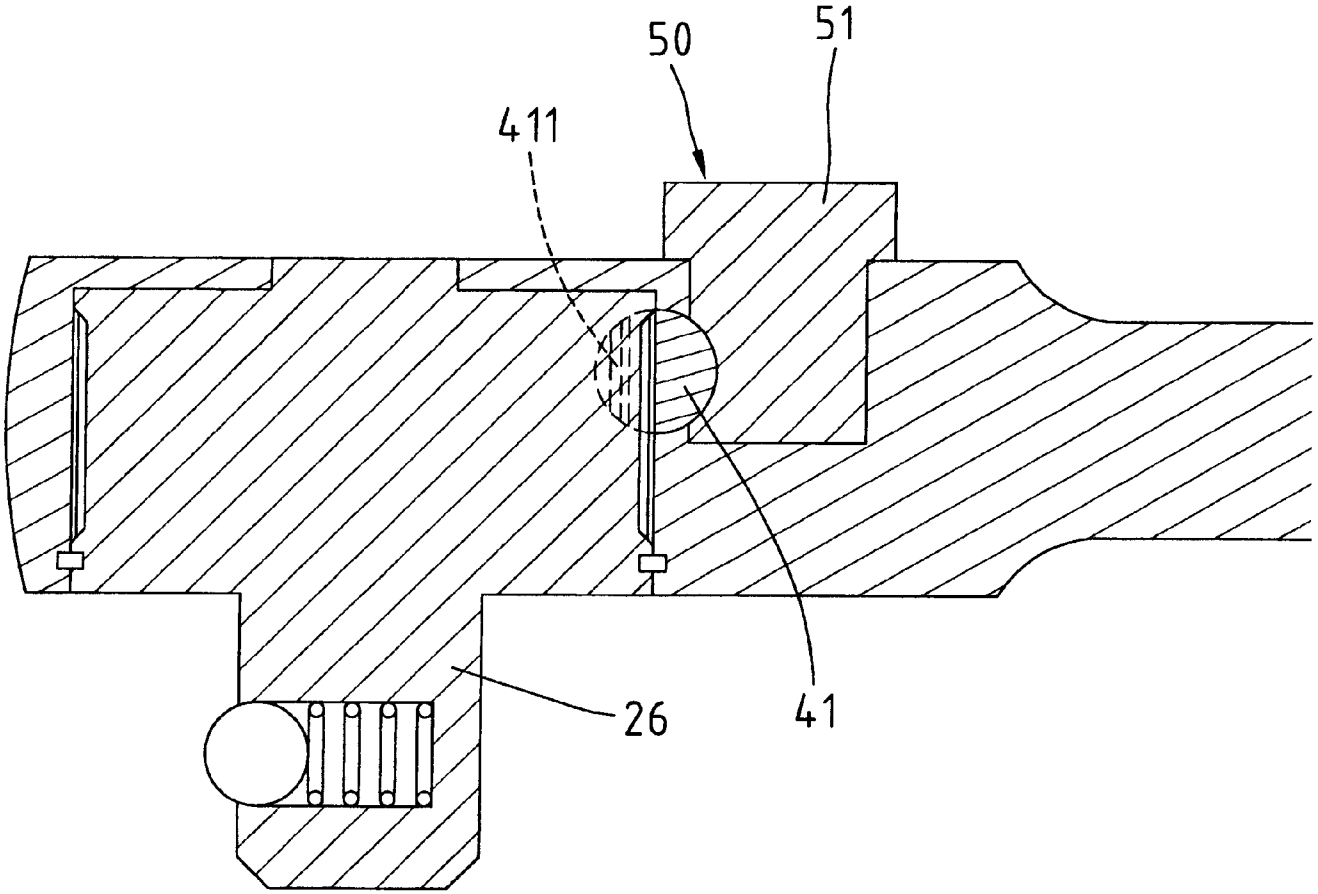
FIG. 6 is a sectional view illustrating a modified embodiment of the gear wheel of the wrench in FIG. 1.
Figure 7:
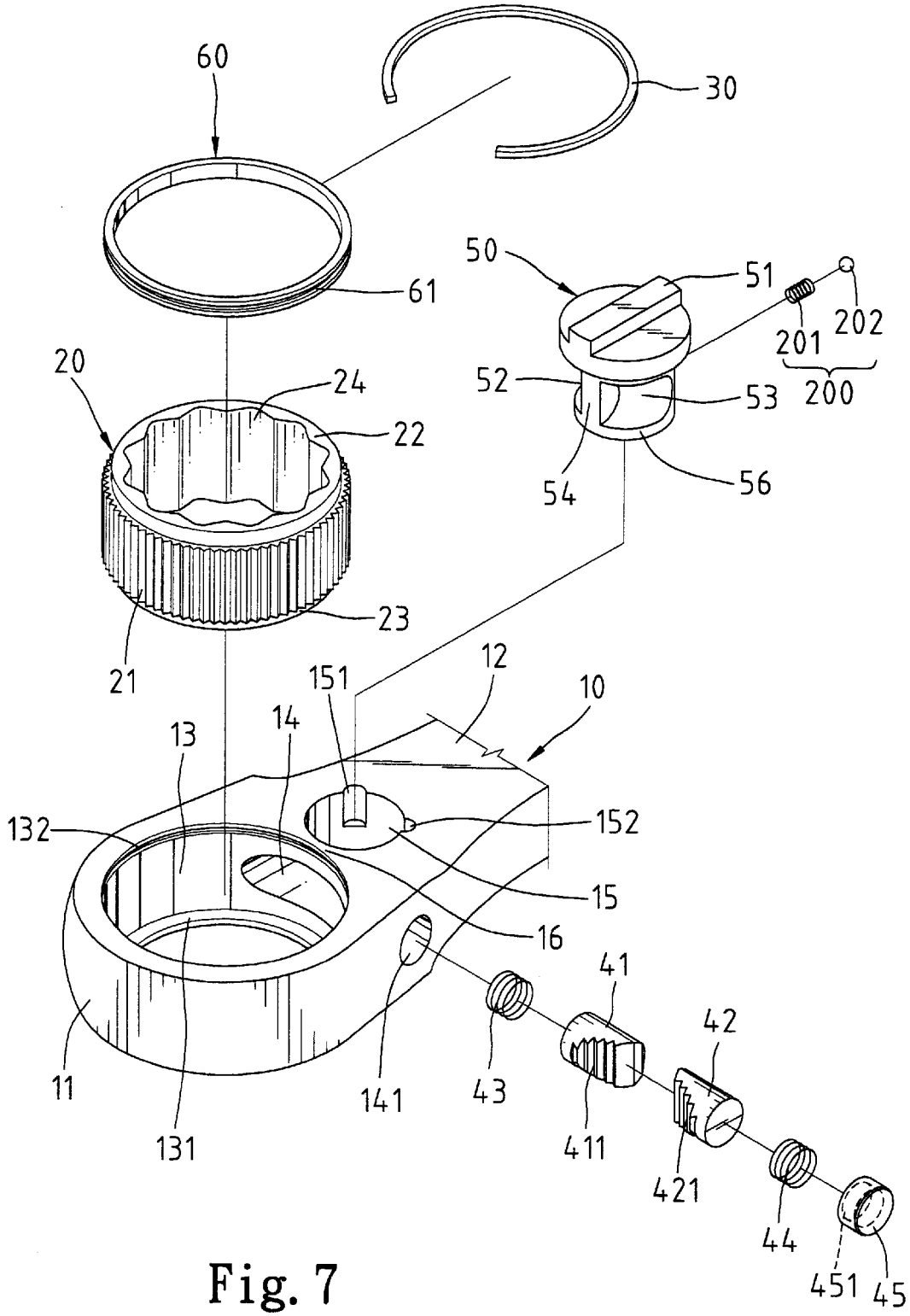
FIG. 7 is an exploded perspective view of another modified embodiment of the wrench in accordance with the present invention.
Figure 8:
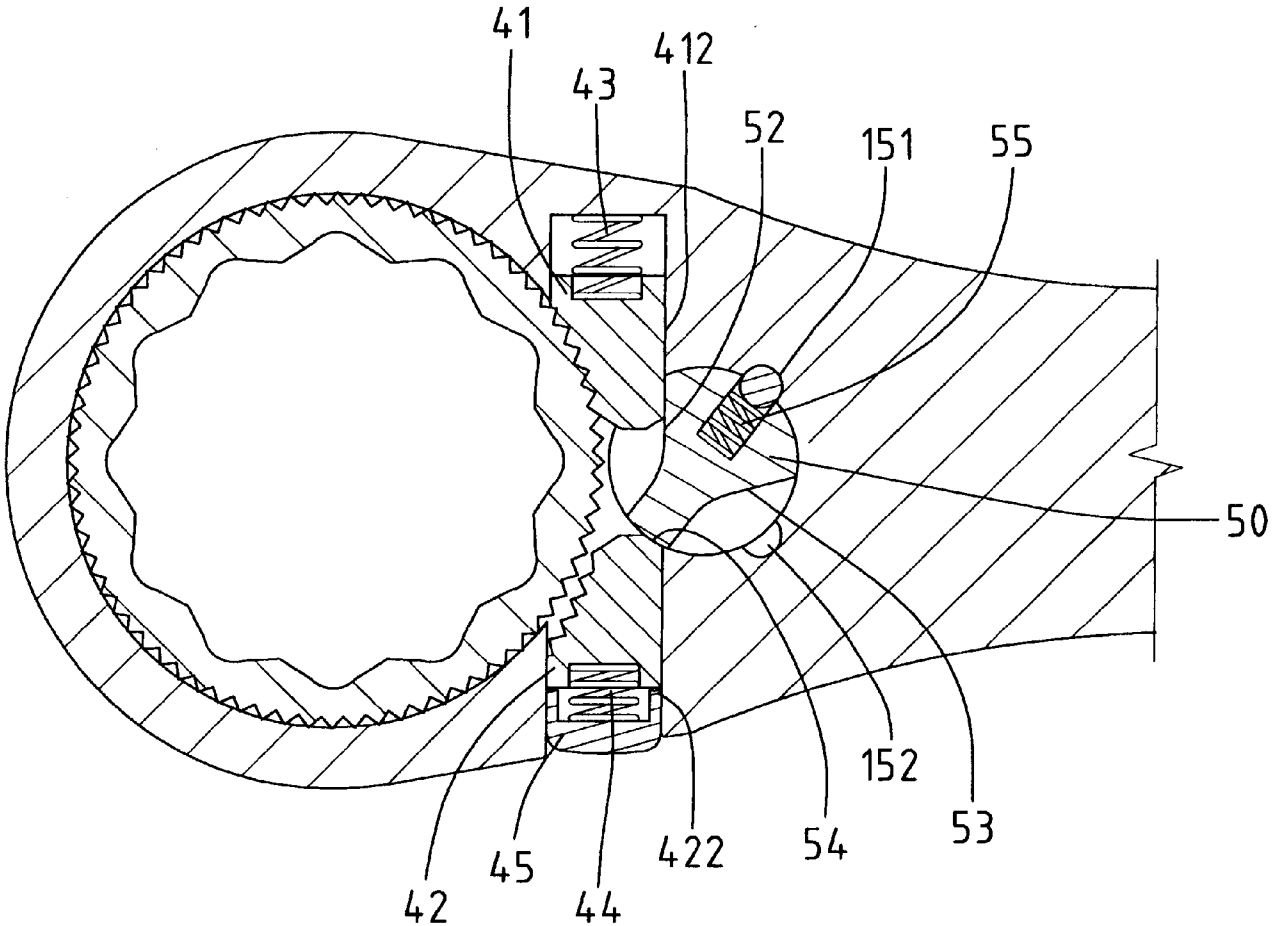
FIG. 8 is a sectional view, taken along line 8—8 in FIG. 10, of the wrench in FIG. 7, wherein the wrench is in a status allowing clockwise ratcheting.
Figure 9:
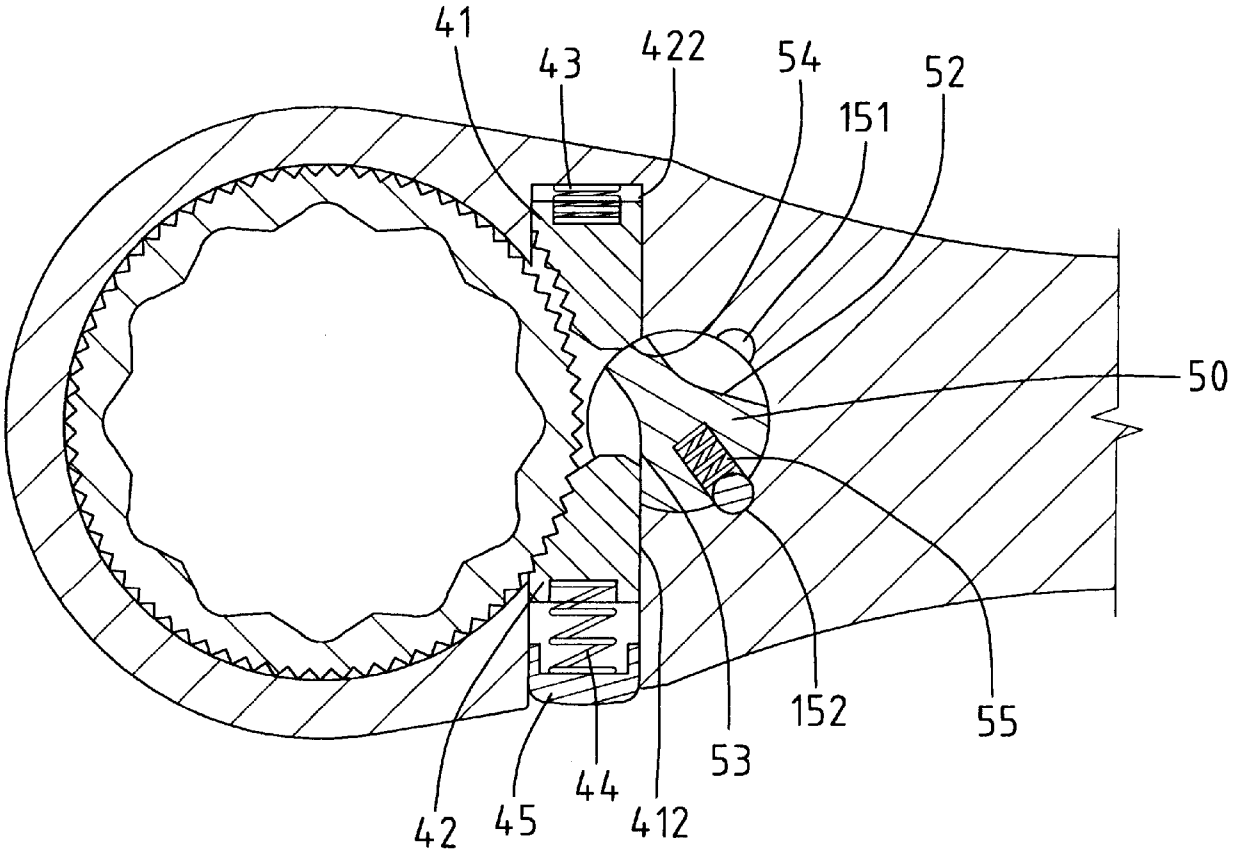
FIG. 9 is a view similar to FIG. 8, wherein the wrench is in a status allowing counterclockwise ratcheting.
Figure 10:
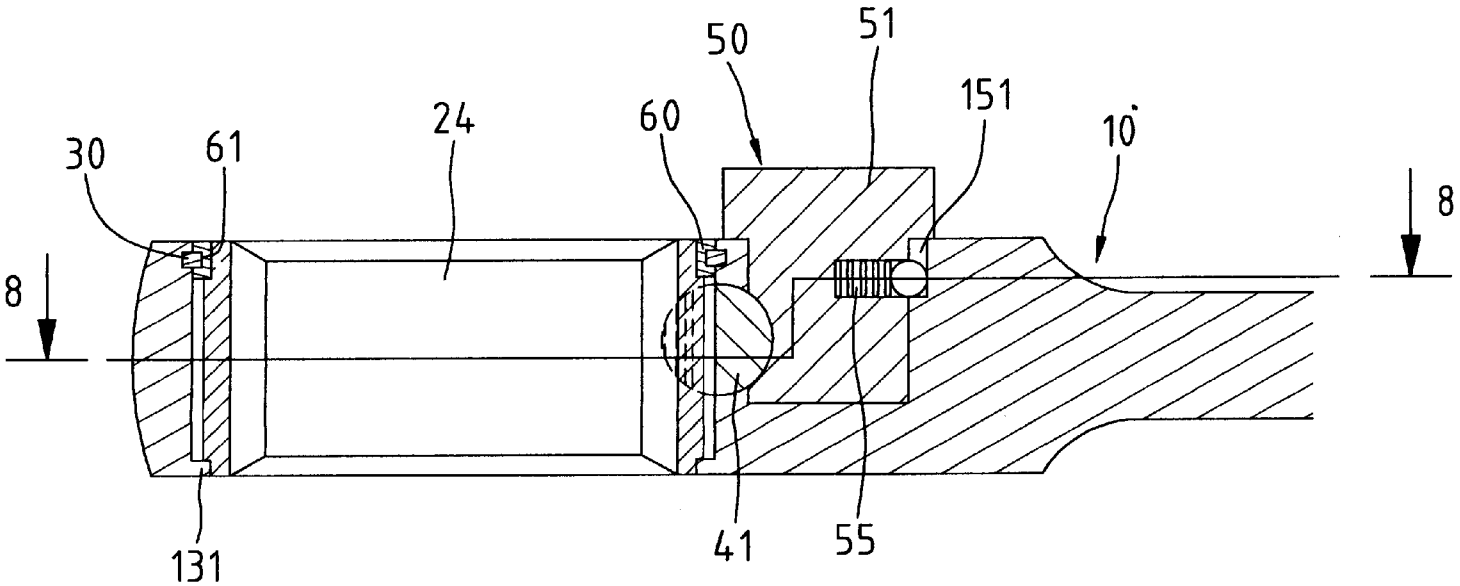
FIG. 10 is a sectional view of the wrench in FIG. 7.

FIG. 6 is a modified embodiment of the wrench in accordance with the present invention, wherein the gear wheel 20 in the above embodiment is replaced by a drive member of the type having a drive column 26.

FIGS. 7 through 10 illustrates another modified embodiment in accordance with the present invention, wherein the cavity 15 includes a first positioning recess 151 and a second positioning recess 152 that can be processed from the upper side of the handle 12 by means of a conventional drilling or milling machine, which is very easy to manufacture. In addition, the switch member 50 comprises a receptacle 55 for receiving a positioning means 200 comprising a spring 201 and a ball 202. The ball 202 is biased by the spring 201 to be selectively engaged in a respective positioning recess 151, 152 according to the ratcheting direction of the wrench. More particularly, the switch member 50 can be reliably retained in place during ratcheting operation by means of provision of the positioning recesses 151 and 152 and the positioning means 200.

Figure 11:
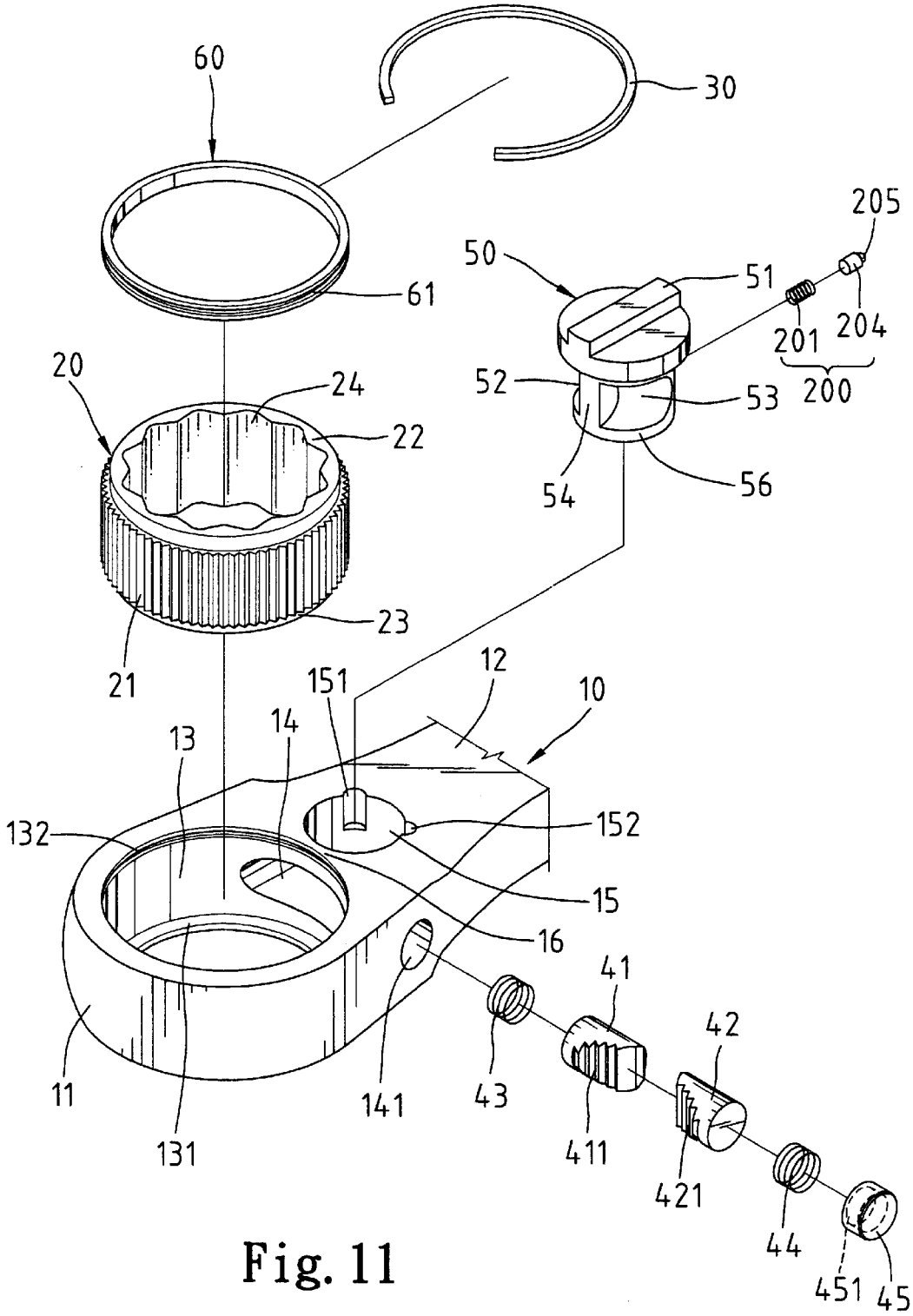
FIG. 11 is an exploded perspective view of a further modified embodiment of the wrench in accordance with the present invention.
Figure 12:
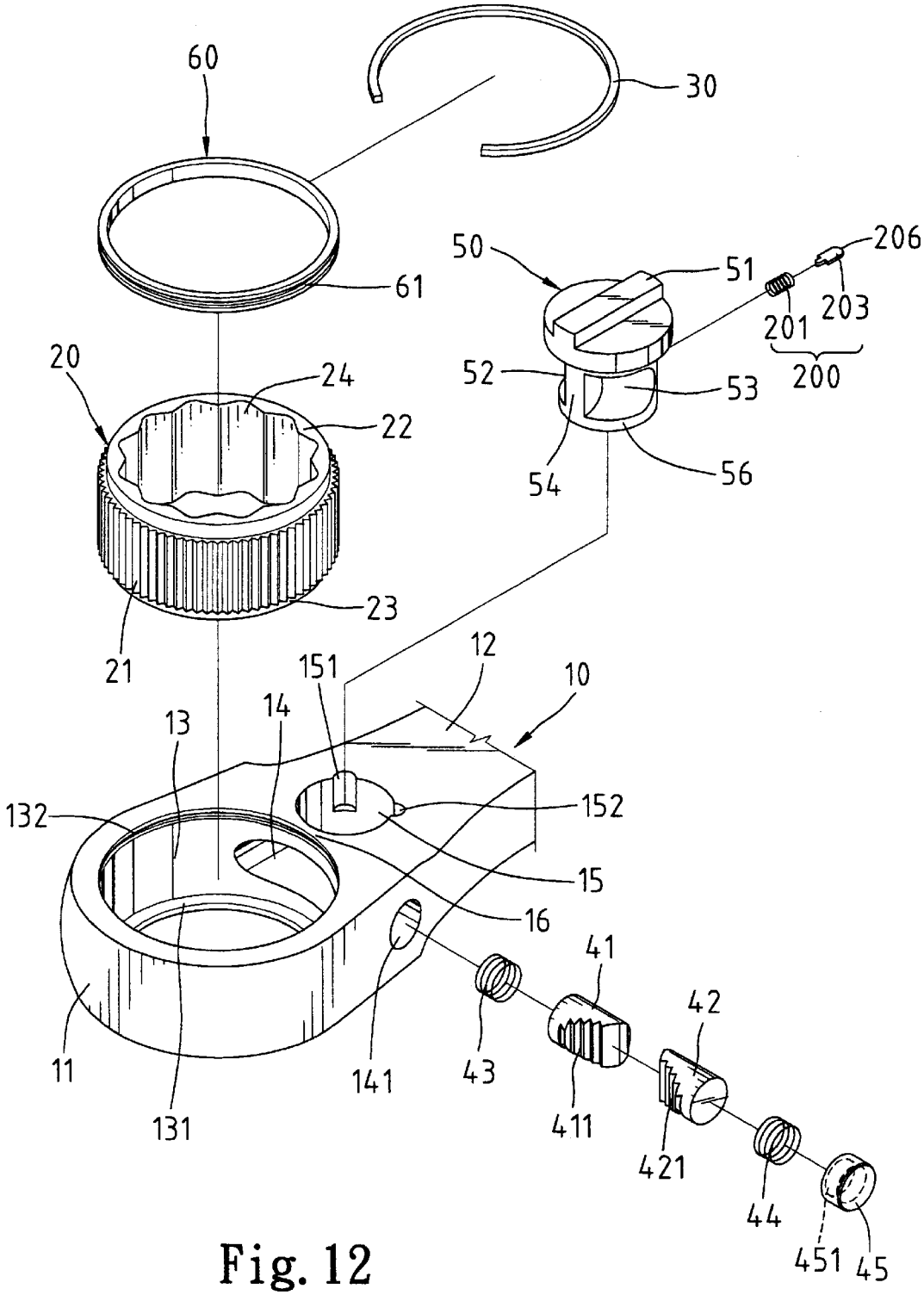
FIG. 12 is an exploded perspective view of still another modified embodiment of the wrench in accordance with the present invention.
Figure 13:
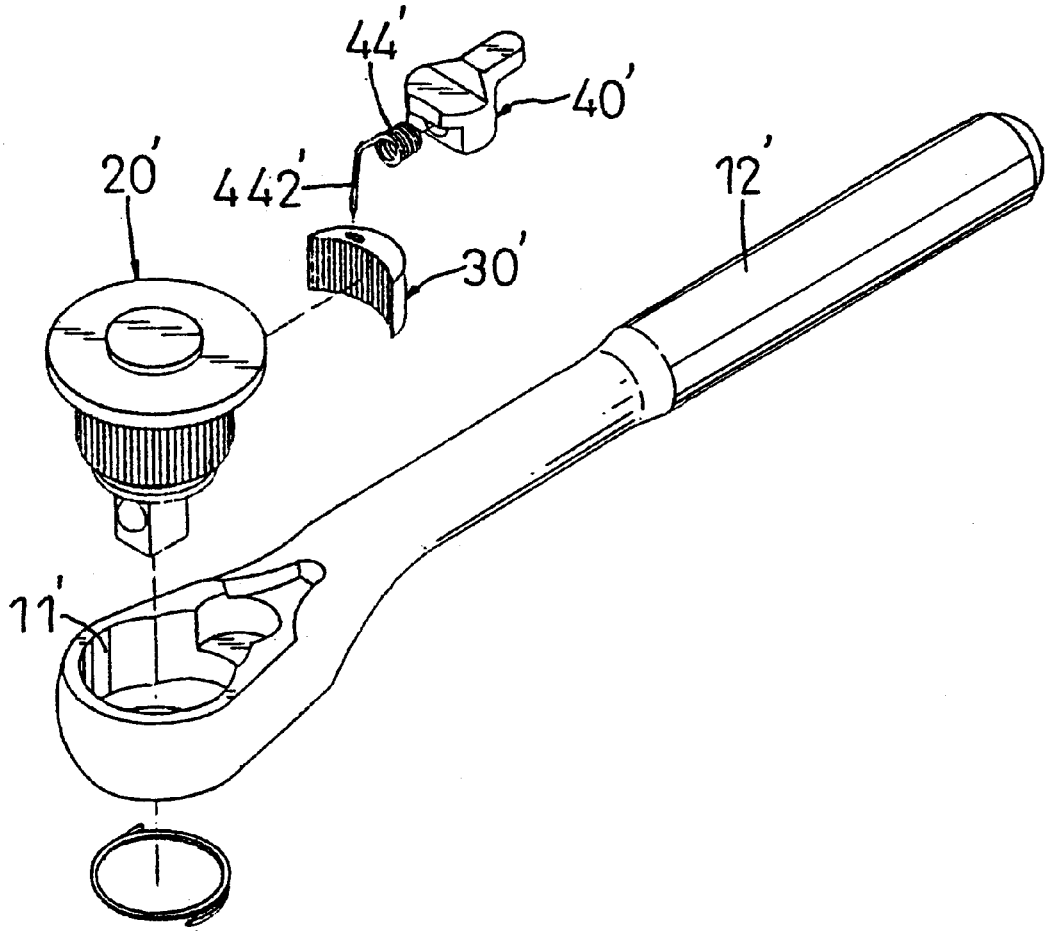
Fig. 13 PRIOR ART
FIG. 13 is an exploded perspective view of a conventional ratchet type wrench.
Figure 14:
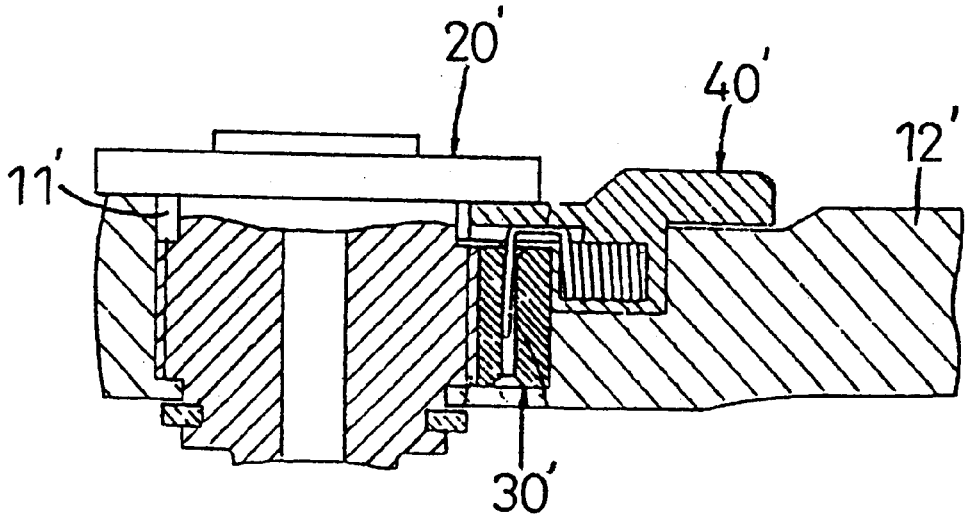
Fig. 14 PRIOR ART
FIG. 14 is a sectional view of a head portion of the conventional ratchet type wrench in FIG. 13.
Figure 15:
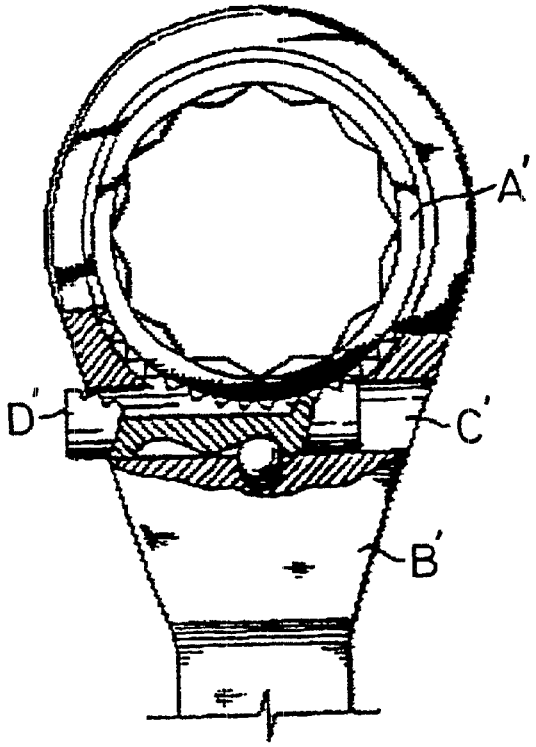
Fig. 15 PRIOR ART
FIG. 15 is a top view, partly sectioned, of a portion of a conventional wrench.
Figure 16:
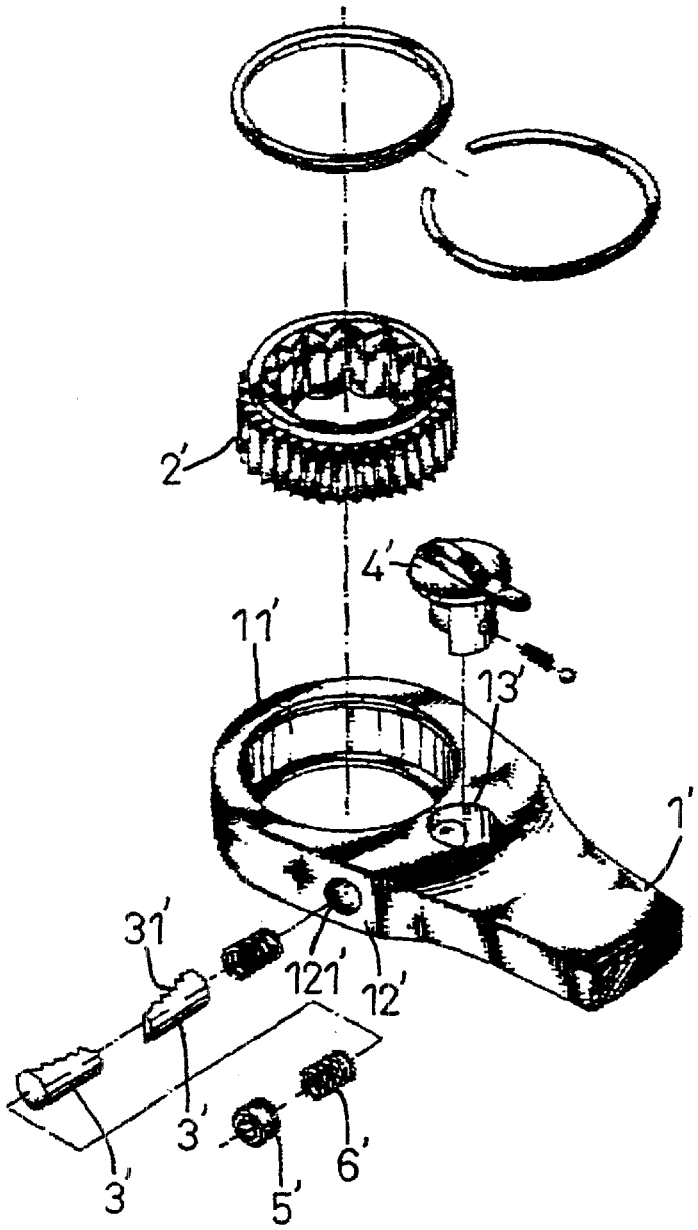
Fig. 16 PRIOR ART
FIG. 16 is an exploded view of a portion of another conventional wrench.
Figure 17:
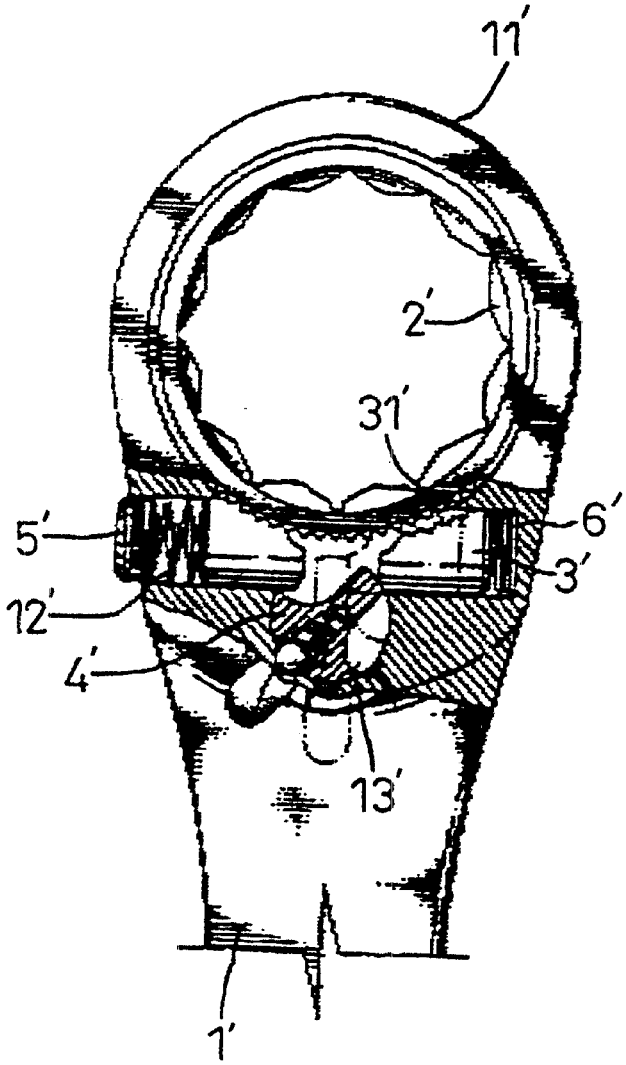
Fig. 17 PRIOR ART
FIG. 17 is a top view, partly sectioned, of the portion of the conventional wrench in FIG. 16.
Figure 18:
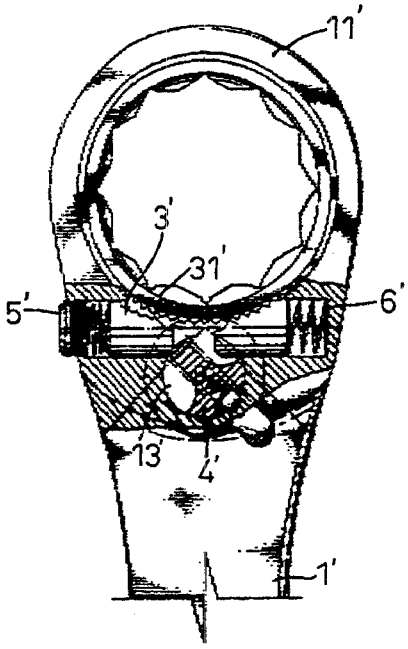
Fig. 18 PRIOR ART
FIG. 18 is a view similar to FIG. 17, wherein the switch member of the wrench is in a position for ratcheting in a reverse direction.
Figure 19:
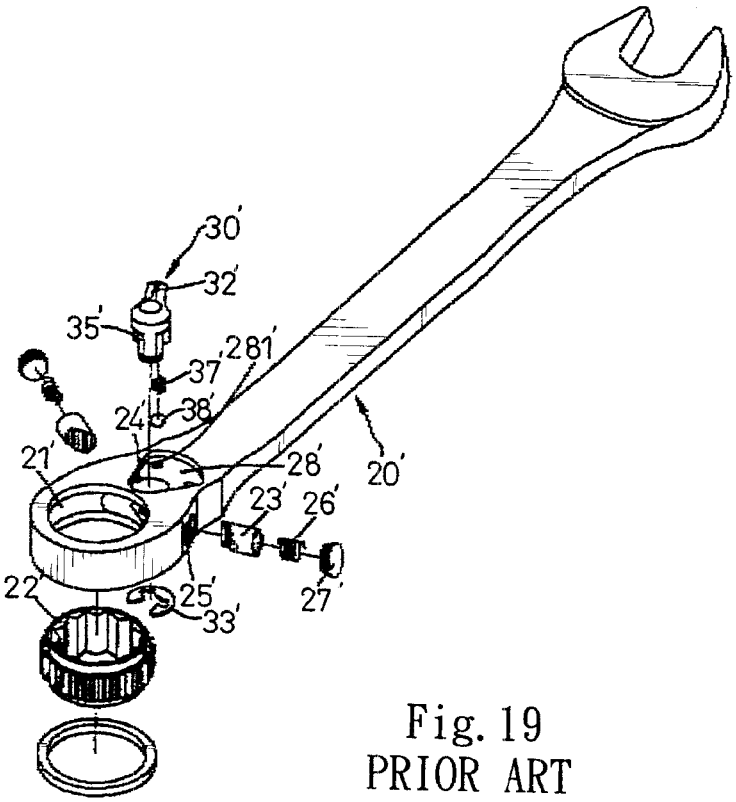
Fig. 19 PRIOR ART
FIG. 19 is an exploded perspective view of a further conventional wrench.
Figure 20:
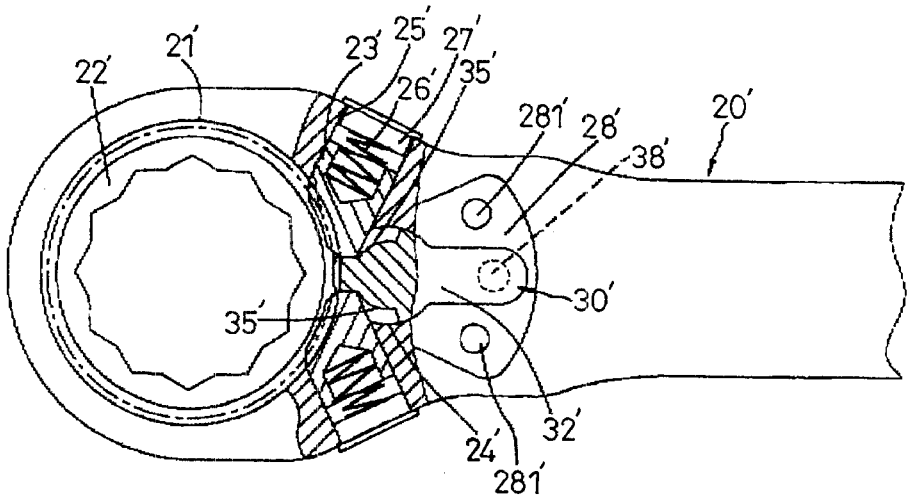
Fig. 20 PRIOR ART
FIG. 20 is a top view, partly sectioned, of a portion of the conventional wrench in FIG. 19.
Figure 21:
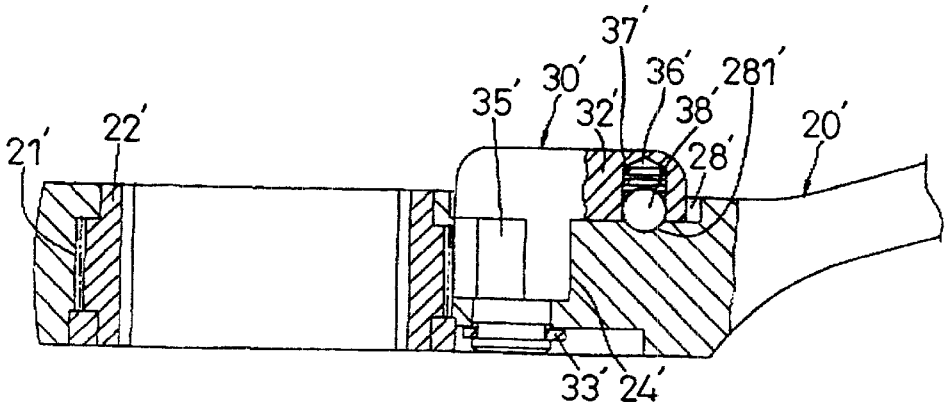
Fig. 21 PRIOR ART
FIG. 21 is a side view, partly sectioned, of the portion of the conventional wrench in FIG. 19.

FIG. 11 is an exploded perspective of a further modified embodiment that is modified from the embodiment shown in FIGS. 7 through 10. In this embodiment, the ball is replaced by a pin 204 having a dome 205. FIG. 12 is an exploded perspective of still another modified embodiment that is modified from the embodiment shown in FIGS. 7 through 10. In this embodiment, the ball is replaced by a sheet-like positioning member 203 having an arcuate end 206.

According to the above description, it is appreciated that the torque-bearing capacity of the wrench in accordance with the present invention is greater than conventional designs. In addition, the wrench in accordance with the present invention can be assembled easily. It is noted that the switch member 50 can be assembled without the need of any C-clip or other fasteners. Disengagement of the switch member 50 is prevented by provision of the bottom 56 of the switch member 50 that is located below the pawls 41 and 42. Further, the positioning notches 151 and 152 of the cavity 15 can be formed by means of punching along a vertical direction and then trimming the burs, which is much simpler than formation of an angled-cavity in conventional designs.

Although the invention has been explained in relation to its preferred embodiment, it is to be understood that many other possible modifications and variations can be made without departing from the spirit and scope of the invention as hereinafter claimed.

What is claimed is:

1. A reversible ratchet type wrench comprising:

a handle;

a head extended from the handle and including a hole, the handle comprising a receptacle communicated with the hole, the receptacle comprising an inner wall that faces the hole of the head, the handle further comprising a cavity that communicates with the receptacle;

a drive member rotatably mounted in the hole of the head, the drive member including a plurality of teeth formed on an outer periphery thereof;

two pawls mounted in the receptacle in a spaced manner, with the two pawls being independent from each other and each including a first side with a plurality of teeth for releasably engaging with the teeth of the drive member and a second side abutting against the inner wall of the receptacle;

a switch member including a turn-piece for manual operation, the switch member being rotatably mounted in the cavity of the handle and comprising an actuating portion for selectively moving one of the pawls to a position not engaging with the teeth of the drive member by rotation of the switch member in the cavity, the switch member further comprising two support portions for selectively supporting a portion of the other pawl that disengages from the inner wall of the receptacle while said one of the pawls is in the position not engaging with the teeth of the drive member, with the support portions being linear from an outer periphery to the actuating portion corresponding to and for abutting the second sides of the pawls, with the support portion selectively supporting the portion of the other pawl arranged parallel to and extending contiguously with the inner wall of the receptacle engaged by the second side of the other pawl thereby supporting the other pawl that engages with the teeth of the drive member; and means for biasing the teeth of the pawls to engage with the teeth of the drive member, respectively.

2. The reversible ratchet type wrench as claimed in claim 1, wherein the cavity of the handle extends from a first side of the handle toward a second side of the handle but spaced from the second side of the handle, thereby defining a bridge in the first side of the handle for connection with the head.

3. The reversible ratchet type wrench as claimed in claim 1, wherein the outer periphery of the drive member comprises a first recessed end portion and a second recessed end portion, an inner periphery defining the hole of the head comprising an annular groove in a first end thereof and an annular ledge in a second end thereof, further comprising a retainer mounted in the first end of the head and having a second annular groove, a C-clip being received in the first annular groove of the head and the second annular groove of the retainer, the second recessed portion of the drive member abutting against and being thus supported by the annular ledge of the head.

4. The reversible ratchet type wrench as claimed in claim 1, wherein the two pawls are biased by a first elastic element and a second elastic element, with each of the two pawls including an inner end engageable by the actuating portion and an outer end, with the reversible ratchet type wrench further comprising an end cap for enclosing the receptacle, the first elastic element being mounted in the receptacle and having a first end attached to an end wall defining the receptacle and a second end attached to the outer end of the one of the two pawls, the second elastic element being mounted in the receptacle and having a first end attached to the end cap and a second end attached to the outer end of the other of the two pawls, with the second side of the other pawl being continuously supported between the inner end and the outer end by the inner wall of the receptacle and one of the two support portions.

5. The reversible ratchet type wrench as claimed in claim 1, wherein the plurality of teeth of the pawl are arranged along the first side with a concave shape for intimate contact with the teeth of the drive member.

6. The reversible ratchet type wrench as claimed in claim 1, wherein the drive member is a gear wheel including an inner periphery adapted to drive a fastener.

7. The reversible ratchet type wrench as claimed in claim 1, wherein the drive member includes a drive column for releasably engaging with a socket.

8. The reversible ratchet-type wrench as claimed in claim 1, wherein the switch member comprises a receptacle, the cavity of the handle further comprising a first positioning recess and a second positioning recess, further comprising a positioning means mounted in the receptacle and having a positioning member releasably engaged in one of the first positioning recess and the second positioning recess according to a ratcheting direction of the reversible ratchet type wrench.

9. The reversible ratchet type wrench as claimed in claim 8, wherein the positioning means comprises an elastic element mounted in the receptacle of the switch member and a ball partially received in one of the first positioning recess and the second positioning recess.

10. The reversible ratchet type wrench as claimed in claim 8, wherein the positioning means comprises an elastic element mounted in the receptacle of the switch member and a pin with a dome releasably received in one of the first positioning recess and the second positioning recess.

11. The reversible ratchet type wrench as claimed in claim 8, wherein the positioning means comprises an elastic element mounted in the receptacle of the switch member and a positioning member with an arcuate end releasably received in one of the first positioning recess and the second positioning recess.

12. The reversible ratchet type wrench as claimed in claim 2, wherein the outer periphery of the drive member comprises a first recessed end portion and a second recessed end portion, an inner periphery defining the hole of the head comprising an annular groove in a first end thereof and an annular ledge in a second end thereof, further comprising a retainer mounted in the first end of the head and having a second annular groove, a C-clip being received in the first annular groove of the head and the second annular groove of the retainer, the second recessed portion of the drive member abutting against and being thus supported by the annular ledge of the head.

13. The reversible ratchet type wrench as claimed in claim 2, wherein the two pawls are biased by a first elastic element and a second elastic element, with each of the two pawls including an inner end engageable by the actuating portion and an outer end, with the reversible ratchet type wrench further comprising an end cap for enclosing the receptacle, the first elastic element being mounted in the receptacle and having a first end attached to an end wall defining the receptacle and a second end attached to the outer end of the one of the two pawls, the second elastic element being mounted in the receptacle and having a first end attached to the end cap and a second end attached to the outer end of the other of the two pawls, with the second side of the other pawl being continuously supported between the inner end and the outer end by the inner wall of the receptacle and one of the two support portions.

14. The reversible ratchet type wrench as claimed in claim 2, wherein the plurality of teeth of the pawl are arranged along the first side with a concave shape for intimate contact with the teeth of the drive member.

15. The reversible ratchet type wrench as claimed in claim 2, wherein the drive member is a gear wheel including an inner periphery adapted to drive a fastener.

16. The reversible ratchet type wrench as claimed in claim 2, wherein the drive member includes a drive column for releasably engaging with a socket.

17. The reversible ratchet-type wrench as claimed in claim 2, wherein the switch member comprises a receptacle, the cavity of the handle further comprising a first positioning recess and a second positioning recess, further comprising a positioning means mounted in the receptacle and having a positioning member releasably engaged in one of the first positioning recess and the second positioning recess according to a ratcheting direction of the reversible ratchet type wrench.

18. The reversible ratchet type wrench as claimed in claim 17, wherein the positioning means comprises an elastic element mounted in the receptacle of the switch member and a ball partially received in one of the first positioning recess and the second positioning recess.

19. The reversible ratchet type wrench as claimed in claim 17, wherein the positioning means comprises an elastic element mounted in the receptacle of the switch member and a pin with a dome releasably received in one of the first positioning recess and the second positioning recess.

20. The reversible ratchet type wrench as claimed in claim 17, wherein the positioning means comprises an elastic element mounted in the receptacle of the switch member and a positioning member with an arcuate end releasably received in one of the first positioning recess and the second positioning recess.

* * * * *